US010654058B2

(12) United States Patent
Bistolfi

(10) Patent No.: US 10,654,058 B2
(45) **Date of Patent: *May 19, 2020**

(54) DISPENSING HEAD FOR A TRIGGER DISPENSING DEVICE PROVIDED WITH A RETURN SPRING

(71) Applicant: GUALA DISPENSING S.p.A., Alessandria (IT)

(72) Inventor: Maurizio Bistolfi, Alessandria (IT)

(73) Assignee: GUALA DISPENSING S.p.A., Alessandria (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/510,624

(22) Filed: Jul. 12, 2019

(65) Prior Publication Data

US 2019/0336999 A1 Nov. 7, 2019

Related U.S. Application Data

(63) Continuation of application No. 15/768,790, filed as application No. PCT/IB2016/055702 on Sep. 23, 2016, now Pat. No. 10,434,529.

(30) Foreign Application Priority Data

Dec. 28, 2015 (IT) ..... 102015000087894

(51) Int. Cl.
*B05B 11/00* (2006.01)

(52) U.S. Cl.
CPC ..... *B05B 11/3011* (2013.01); *B05B 11/3077* (2013.01); *B05B 11/3064* (2013.01); *B05B 11/3074* (2013.01)

(58) Field of Classification Search
CPC ..... B05B 11/3011; B05B 11/3009; B05B 11/3077; B05B 11/3073; B05B 11/3016; B05B 11/3047; B05B 11/3064
(Continued)

(56) References Cited

U.S. PATENT DOCUMENTS 5,706,984 A * 1/1998 Tada ..... B05B 1/12 222/182
7,175,056 B2 2/2007 Buti
(Continued)

FOREIGN PATENT DOCUMENTS

EP 1 500 436 A1 1/2005
EP 1 923 140 A1 5/2008
(Continued)

OTHER PUBLICATIONS

International Search Report and Written Opinion of the International Searching Authority for International Patent Application No. PCT/IB2016/055702 dated Jan. 24, 2017, 11 pages.
(Continued)

*Primary Examiner* — Lien M Ngo
(74) *Attorney, Agent, or Firm* — Merchant & Gould P.C.

(57) ABSTRACT

A dispensing head (1) for a trigger dispensing device includes a return spring (50) provided with a pair of main arms (52, 54), secondary arms (62, 64) which extend from the main arms (52, 54) and an abutment portion (70) that connects the secondary arms (62, 64). The abutment portion (70) and/or the secondary arms (62, 64) are applied to the frame (2) to create a constraint and give rise to a return action.

5 Claims, 8 Drawing Sheets

(58) Field of Classification Search
USPC ..... 222/383, 1, 380, 384, 340, 321.8, 214, 222/336, 406, 407, 372, 341; 239/329, 239/331, 333, 375
See application file for complete search history.

(56) References Cited

U.S. PATENT DOCUMENTS

| | | | | |
|---|---|---|---|---|
| 8,800,822 | B2 * | 8/2014 | Good | B05B 11/3011 222/382 |
| 9,975,130 | B2 | 5/2018 | Dejong et al. | |
| 2007/0210116 | A1 * | 9/2007 | Clynes | B05B 11/3011 222/340 |
| 2009/0050653 | A1 | 2/2009 | Maas et al. | |
| 2011/0036871 | A1 * | 2/2011 | Tada | B05B 11/3011 222/383.1 |
| 2014/0014691 | A1 | 1/2014 | Foster et al. | |

FOREIGN PATENT DOCUMENTS

| | | | | |
|---|---|---|---|---|
| JP | H09-253540 | A1 | | 9/1997 |
| JP | 10-128184 | A | * | 5/1998 |
| JP | H10-128184 | A | | 5/1998 |
| JP | 10-146546 | A | * | 6/1998 |
| JP | H11-57547 | A1 | | 3/1999 |
| RU | 2054323 | C1 | | 2/1996 |
| RU | 2229348 | C2 | | 5/2004 |
| WO | 2010/041411 | A1 | | 4/2010 |
| WO | 2010/067507 | A1 | | 6/2010 |
| WO | 2010/124040 | A2 | | 10/2010 |
| WO | 2011/128786 | A1 | | 10/2011 |

OTHER PUBLICATIONS

Russian Office Action for corresponding Russian Patent Application No. 2018124336 dated Oct. 10, 2019, 6 pages.

* cited by examiner

DISPENSING HEAD FOR A TRIGGER DISPENSING DEVICE PROVIDED WITH A RETURN SPRING

This is a Continuation of U.S. patent application Ser. No. 15/768,790, filed 16 Apr. 2018, which is a National Stage Application of PCT/IB2016/055702, filed 23 Sep. 2016, which claims benefit of Serial No. 102015000087894, filed 28 Dec. 2015 in Italy and which applications are incorporated herein by reference. To the extent appropriate, a claim of priority is made to each of the above-disclosed applications.

BACKGROUND OF THE INVENTION

This invention relates to the sector of manual trigger-dispensing devices for liquids, for example for the hygiene of the home, the deodorisation of rooms, the treatment of fabrics before ironing, and the like. In particular, this invention relates to a dispensing head for a trigger dispensing device provided with a spring for the return of the trigger.

Trigger dispensing devices are very widespread, as can be seen on supermarket shelves, especially for their ease of use and functionality. Every year many hundreds of millions of pieces are produced.

Therefore, it is understandable that even a slight improvement in the production process or a slight change of the components, such as to allow for example a structural simplification or a saving of raw material, can actually have a significant impact on the profitability of production.

One of the essential components for such trigger dispensing devices is the return spring which, after the actuation of the trigger, returns it to its initial rest position.

The return spring is a critical component of the dispensing device. For example, it is repeatedly stressed during the life of the dispensing device, for which it must be sufficiently robust to prevent any breakages or made of suitable materials, which are often expensive. For example, acetal resin, such as POM (Polyoxymethylene) is often used.

Furthermore, during assembly of the dispensing head, the application of the trigger to the frame and the return spring between the trigger and frame, is always a critical step and has to be carried out at a reduced speed, often not satisfactory compared to those attainable in other production steps.

SUMMARY OF THE INVENTION

The purpose of this invention is to provide a dispensing head provided with a return spring that meets the needs of the sector and overcomes the drawbacks referred to above.

BRIEF DESCRIPTION OF THE DRAWINGS

The characteristics and advantages of the dispensing head according to this invention will be apparent from the following description, given by way of non-limiting example, according to the accompanying figures, in which.

DETAILED DESCRIPTION OF THE PREFERRED EMBODIMENTS

Figure 1:
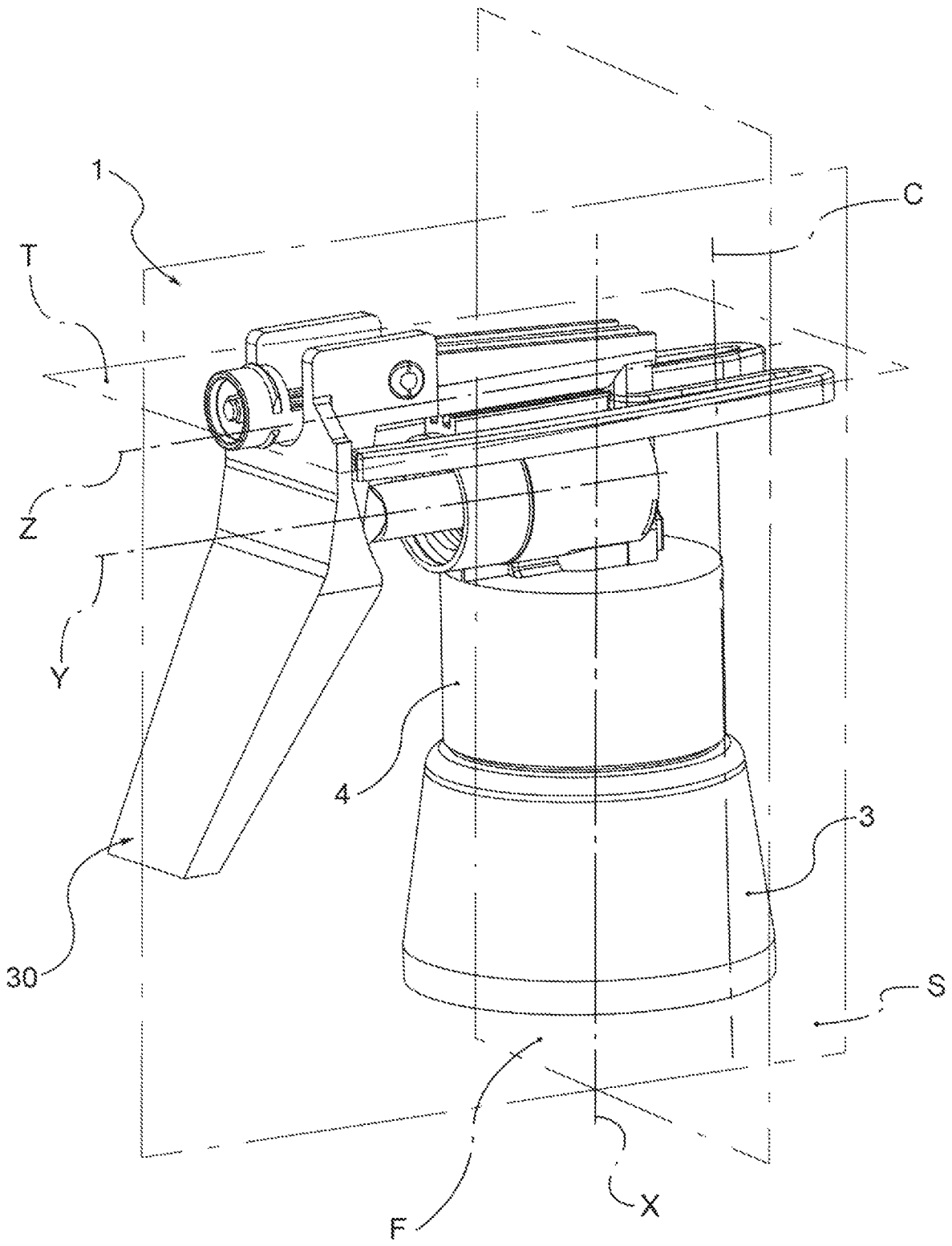
FIG. 1 shows a dispensing head according to this invention, applied to a bottle.
Figure 2:
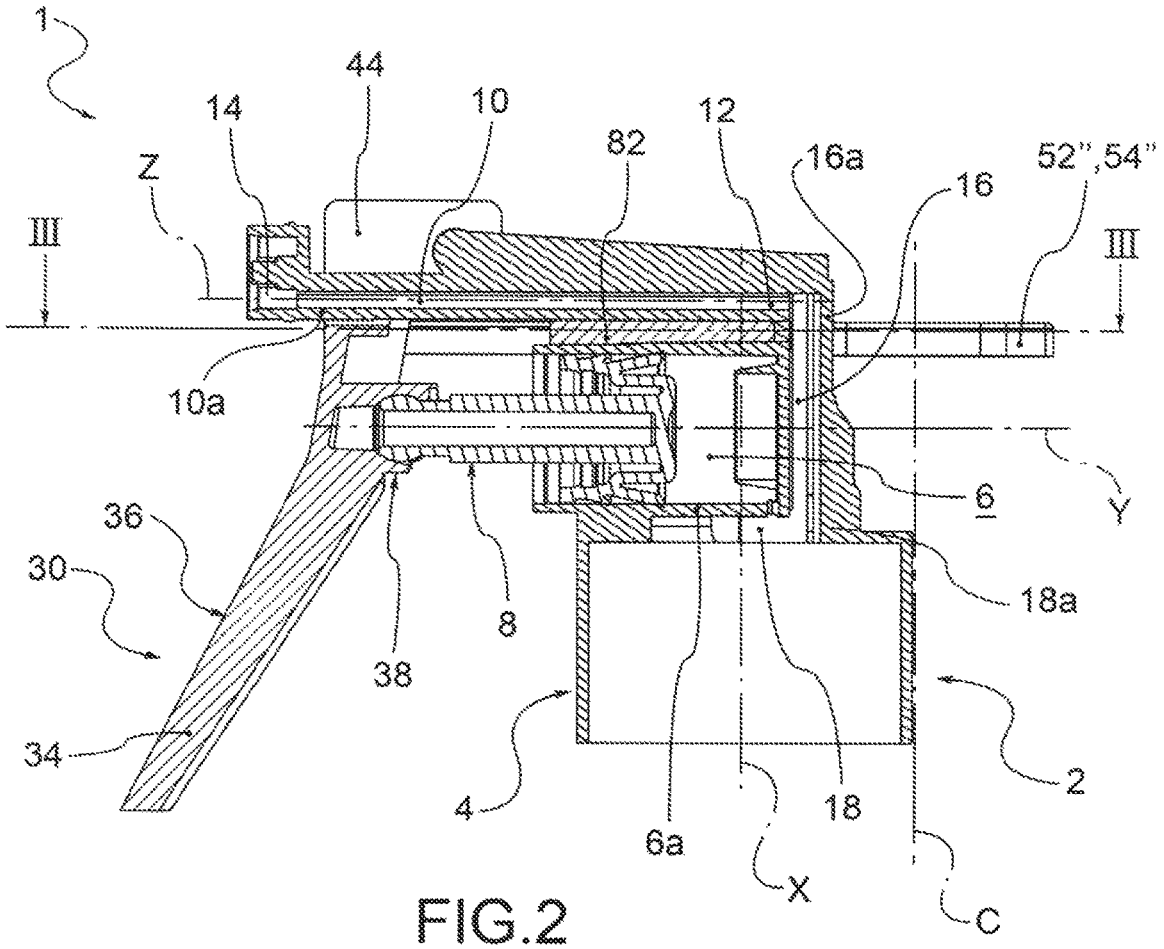
FIG. 2 shows a sagittal sectional view of the dispensing head of FIG. 1.
Figure 3:
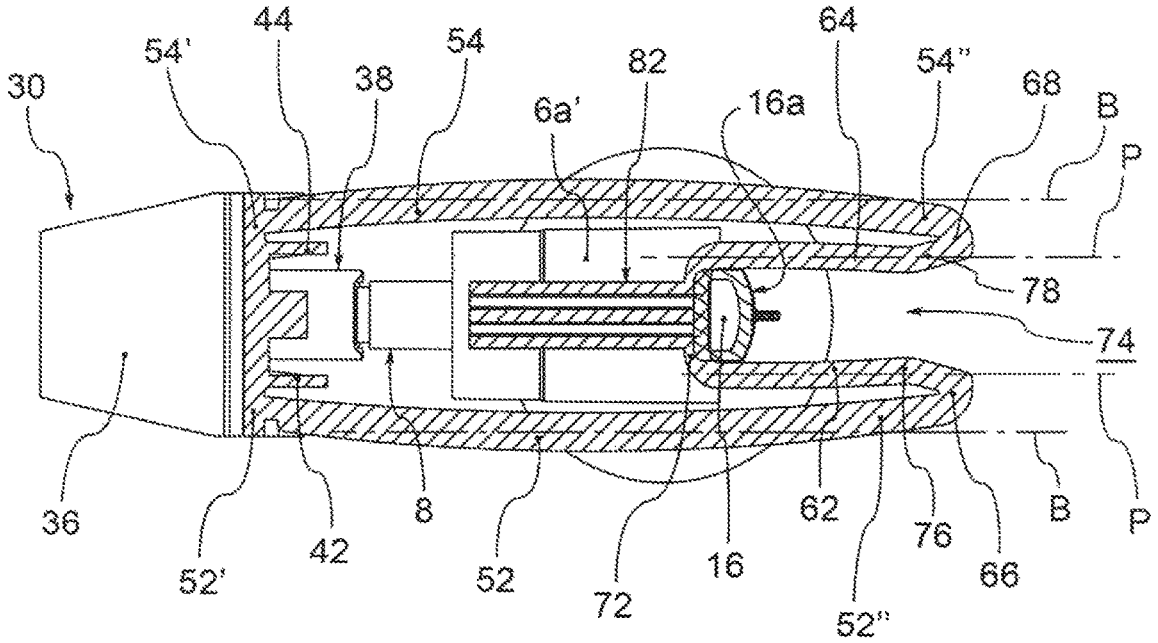
FIG. 3 is a section view of the dispensing head of FIG. 1, along the section plane of FIG. 2.
Figure 4:
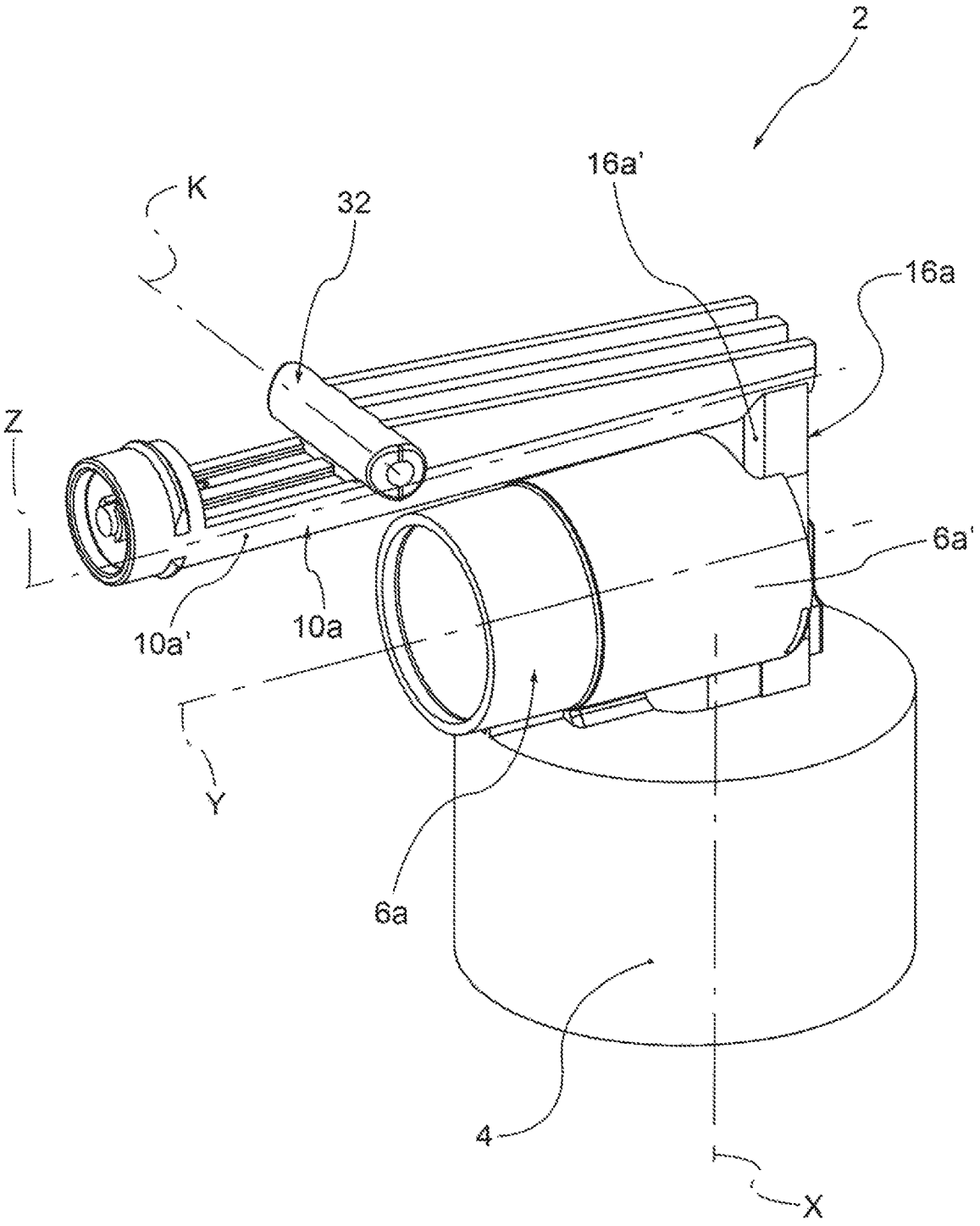
FIG. 4 shows a frame of the dispensing head of FIG. 1.
Figure 6:
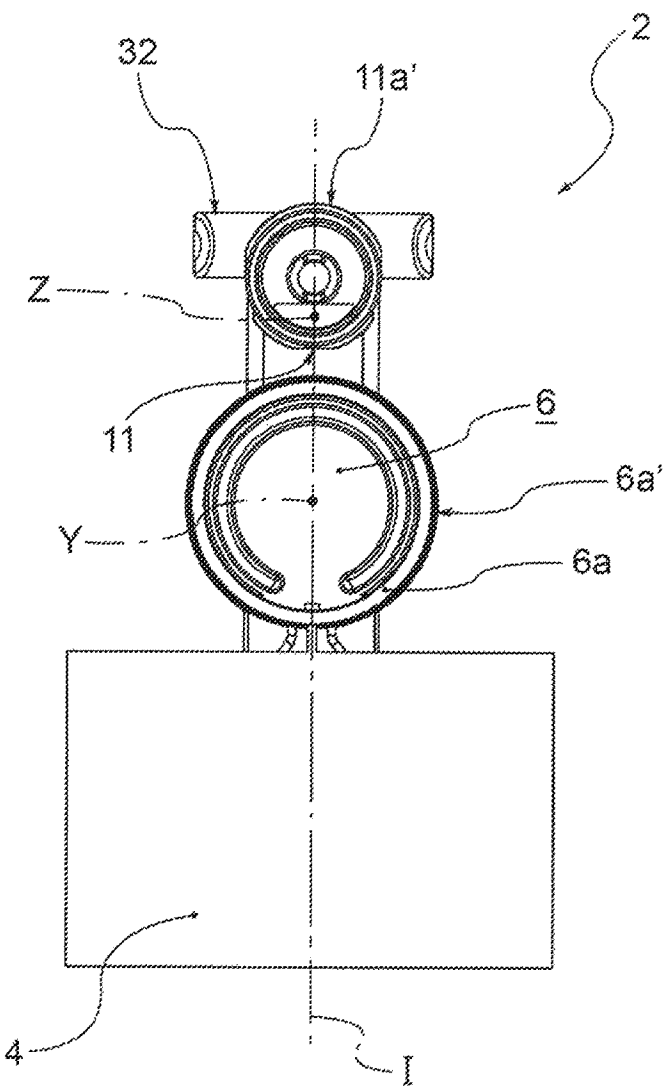
FIG. 6 shows a front view of the frame of FIG. 4.
Figure 5:
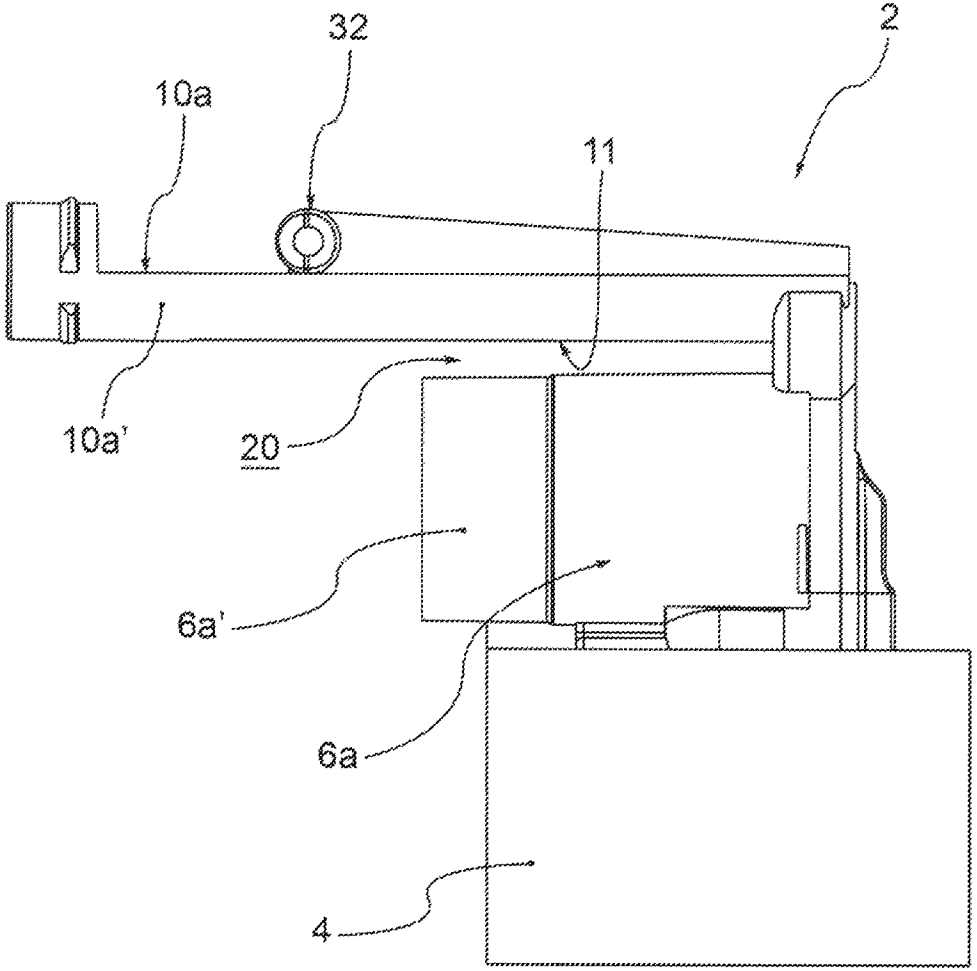
FIG. 5 shows a side view of the frame of FIG. 4.
Figure 7:
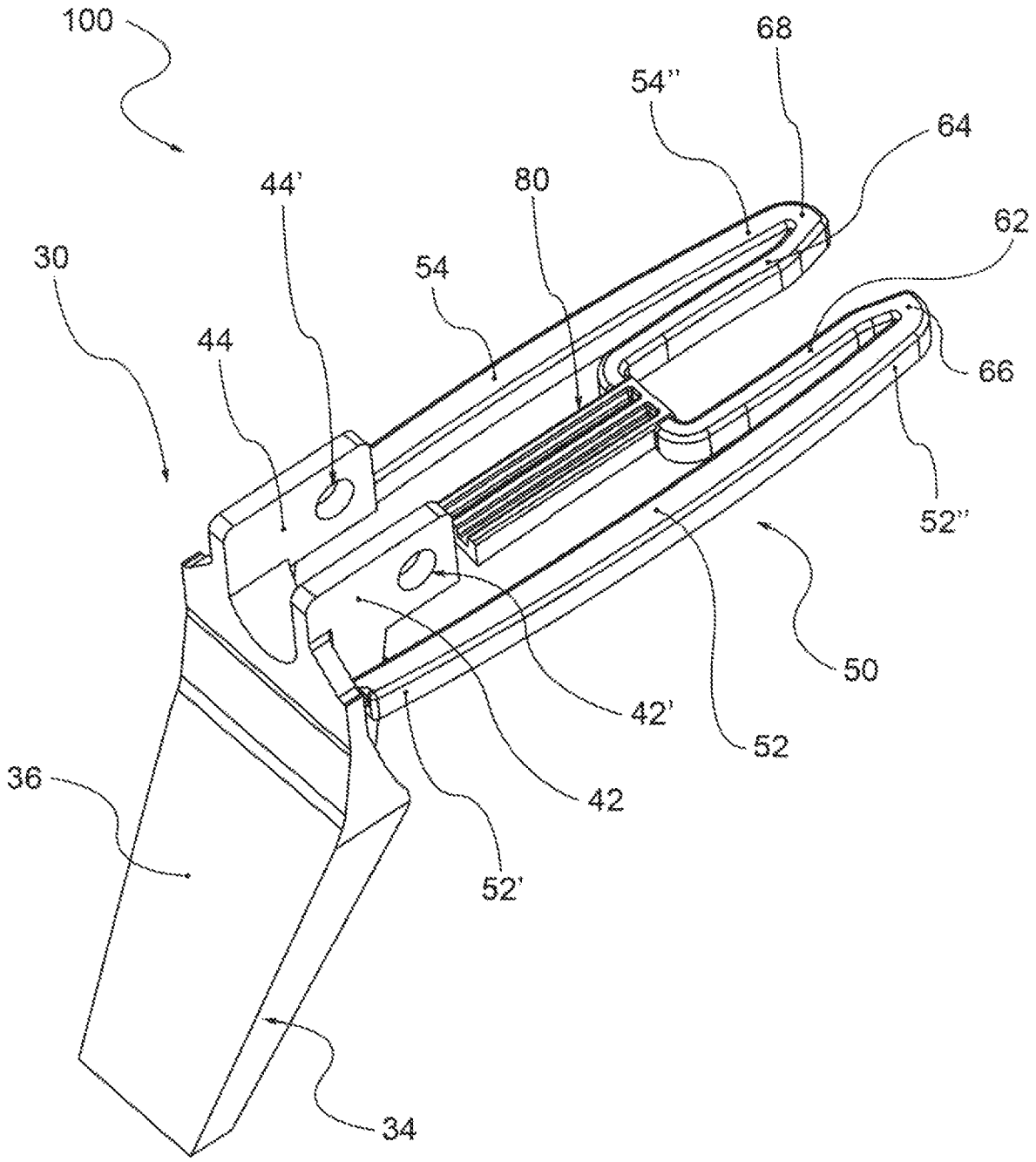
FIG. 7 shows an integrated trigger-spring element of the dispensing head of FIG. 1.
Figure 8:
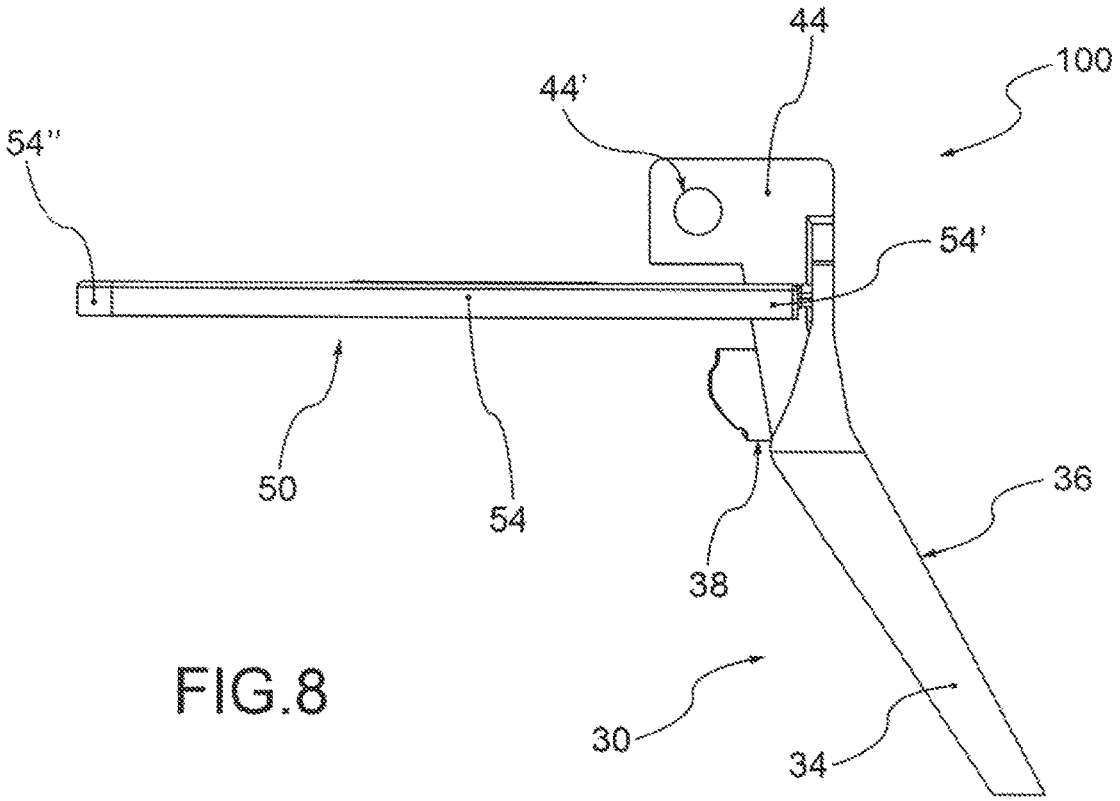
FIG. 8 is a side view of the integrated trigger-spring element of FIG. 7.
Figure 9:
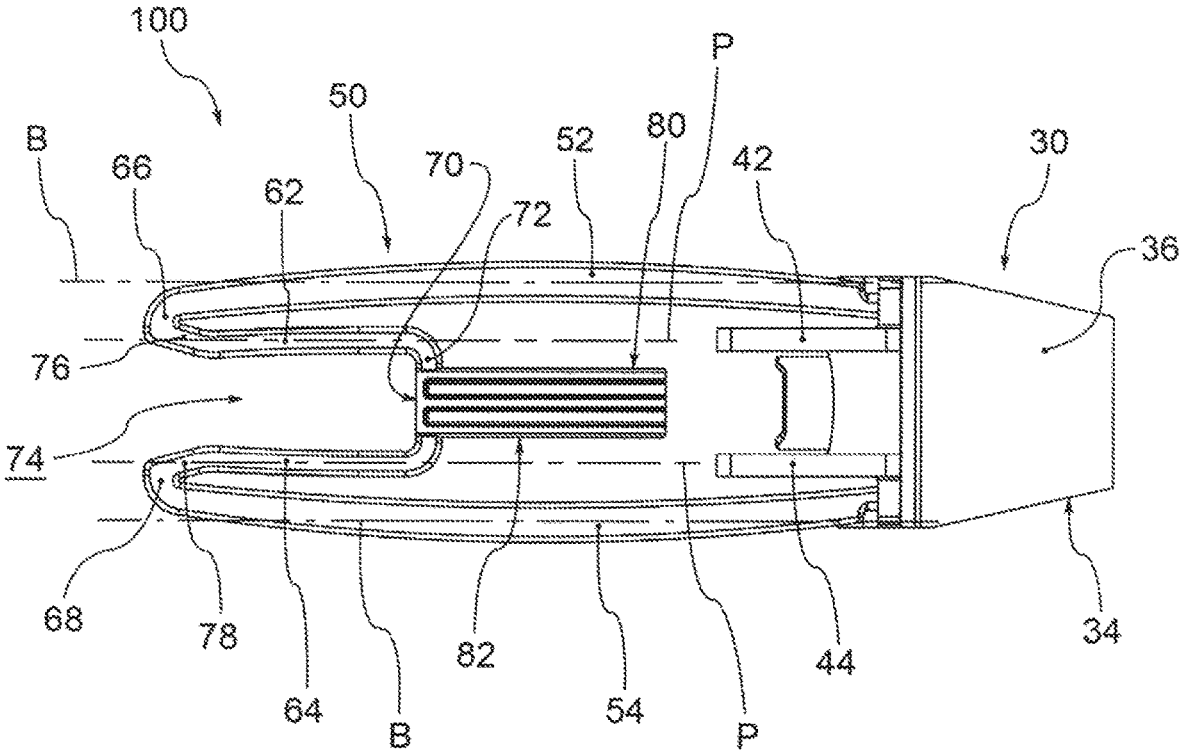
FIG. 9 shows a plan view of the integrated trigger-spring element of FIG. 7.

According to the invention, a manual trigger dispensing device comprises a bottle 3 for containing the liquid and a dispensing head 1, applicable to the bottle 3, in general to a neck of this.

For example, the dispensing head 1 is applicable to the bottle by means of a threading or by a bayonet or snap connection.

The dispensing head 1 comprises a support frame 2, preferably made in a single piece of plastic material, comprising a connection structure for engagement with the bottle 3, provided with a main axis X.

For example, the connection structure is constituted by an annular connecting skirt 4, typically constituted by an annular wall that extends about the main axis or skirt axis X, and is provided with an internal thread or internal tabs for the respective threaded or bayonet connection with the neck of the bottle.

The dispensing head 1 also comprises a pressure chamber 6 for containing the liquid sucked from the bottle and intended to be dispensed to the outside, annularly delimited by a chamber wall 6*a*.

Preferably, the pressure chamber 6 is formed in the support frame 2, which therefore includes the chamber wall 6*a*.

The dispensing head 1 also comprises a piston 8, slidably sealingly received in the pressure chamber 6; the piston 8 is slidable with a reciprocating motion in the pressure chamber 6 along a piston axis Y, incident to the skirt axis X, around which extends the chamber wall 6*a*.

For example, the piston axis Y is orthogonal to the skirt axis X.

In addition, the dispensing head comprises a dispensing duct 10, which extends between a proximal mouth 12 in communication with the pressure chamber 6 and a distal mouth 14 from which the liquid flows towards the outer environment, annularly delimited by a duct wall 10*a*.

Preferably, said dispensing duct 10 extends predominantly along a rectilinear dispensing axis, separate and parallel to the piston axis Y (and therefore incident, preferably orthogonal, to the skirt axis X). The duct wall 10*a* extends annularly around the piston axis Y.

Preferably, in addition, the dispensing duct 10 is formed in the support frame 2, which therefore includes said duct wall 10*a*.

An imaginary plane containing the main axis X of the connection structure 4 and the dispensing axis Z of the dispensing duct 10 is denominated the sagittal plane S, and divides the space in a right half-space and a left half-space, with reference to a user who holds the dispensing device in front of him.

An imaginary plane orthogonal to the sagittal plane S and passing through the dispensing duct Z is denominated transverse plane T; the transverse plane divides the space into an upper half-plane and a lower half-plane in which the connection structure 4 is positioned.

An imaginary plane orthogonal to the sagittal plane S and orthogonal to the transverse plane T and passing through the main axis X is denominated frontal plane F and divides the space into a rear half-space and a front half-space in which the distal end 14 of the dispensing duct 10 is positioned.

According to a preferred embodiment, between the outer surface 6*a*' of the chamber wall 6*a* and the outer surface 10*a*' of the duct wall 10*a*, there is a cavity 20, in correspondence of which the outer surface 10*a*' of the duct wall 10*a* presents a flat region 11, i.e., a kind of levelling.

The flat region 11 is orthogonal to the sagittal plane S and is crossed in the centreline of this.

The dispensing head 1 further comprises a connection duct 16 that connects the pressure chamber 6 with the proximal mouth 12 of the dispensing duct 10; the connection duct 16 is delimited annularly by a connection duct wall 16*a*, having externally an outer surface 16*a'*.

The outer surface 16*a*' of the connection duct wall 16 is placed between the outer surface 6*a*' of the chamber wall 6*a* and the outer surface 10*a*' of the duct wall 10*a*.

The dispensing head 1 comprises valvular dispensing means (not represented), for example with a membrane, operating along the connection duct 16, suitable to regulate the flow of fluid between the pressure chamber 6 and the dispensing duct 10; in particular, said valvular dispensing means are suitable to allow the flow of liquid from the pressure chamber towards the dispensing duct during the step of dispensing the liquid, for example when a predefined pressure threshold is exceeded in the pressure chamber.

In addition, the dispensing head 1 comprises a suction duct 18 that connects the bottle 3 with the pressure chamber 6; the suction duct 18 is delimited by a suction duct wall 18*a*.

The dispensing head 1 also comprises valvular suction means (not represented), for example with a membrane, operating along the suction duct 18, suitable to regulate the flow of fluid between the bottle and the pressure chamber 6; in particular, said valvular suction means are suitable to allow the flow of liquid from the bottle towards the pressure chamber 6 during a phase of suction of the liquid and to prevent the return flow of the liquid from the pressure chamber towards the bottle during a dispensing phase of the liquid.

For example, a single membrane comprises both the valvular suction means and the valvular dispensing means.

The dispensing head 1 also comprises a trigger 30 applied to the frame 2, preferably symmetrical with respect to the sagittal plane S, for example hinged to this in a pin 32 of said frame, which extends along a pin axis K orthogonal to said sagittal plane S.

According to a preferred embodiment, the pin 32 protrudes from the duct wall 10*a* of the dispensing duct 10 and is located in the upper half-space defined by the transverse plane T.

The trigger 30 is suitable to influence the piston 8 and impose its sliding in the pressure chamber 6.

For example, the trigger 30 includes an actuating portion 34 having a front supporting surface 36 for supporting the fingers of a hand, and a connecting portion 38, on the side opposite the support surface 36, for connection with the piston 8, for example by hinging.

The trigger 30 also comprises a pair of tabs 42,44, for example arranged symmetrically with respect to the sagittal plane S, integral with the actuating portion 34 and each provided with a respective hole 42',44' for the rotatable coupling with the pin 32 the frame 2.

The dispensing head 1 also comprises a return spring suitable to operate permanently between the trigger and the frame to influence the trigger towards an initial rest position.

Preferably, the spring 50 is made in a single piece with the trigger 30, thus constituting together a single integrated trigger-spring element 100.

Preferably, the spring 50 comprises a pair of main arms 52,54 that extend from a front end 52',54' located in the front half-plane defined by the frontal plane F and engageable by the actuating portion 34 of the trigger 30, to an opposite rear end 52",54", which is preferably located in the rear half-space defined by the frontal plane F, predominantly along an arm axis B, parallel to the direction of the dispensing axis Z.

Still more preferably, said rear end 52",54" is located externally to the imaginary cylindrical surface C passing through the outer surface 4*a* of the connecting skirt 4.

Preferably, moreover, the main arms 52,54 lie substantially in a plane parallel to the transverse plane T and, preferably, have an arcuate, concave trend towards the sagittal plane S.

Preferably, moreover, when the spring is at rest, the main arms 52,54 are placed in the lower half-space defined by the transverse plane T, and, preferably, are arranged symmetrically with respect to the sagittal plane S.

According to a preferred embodiment, in addition, the front ends 52',54' of the arms 52,54 are joined to the trigger 30, and in particular to the actuating portion 34 of this, in order to constitute the integrated element 100 in one piece.

Furthermore, the spring 50 comprises secondary arms 62,64 that extend starting from the rear end 52",54" of the main arms, to form an extension of said main arms along an axis of extension P distinct from the arm axis B.

For example, preferably, said secondary arms 62,64 extend along a respective extension axis P, parallel to the arm axis B, at least partially overlapping the main arms 52,53 along the direction of said arm axis B.

Preferably, moreover, said secondary arms 62,64 lie on the same imaginary plane, parallel to the transverse plane T, on which lie the main arms 52,54.

Preferably, moreover, the secondary arms 62,64 are proximal to the sagittal plane S with respect to the main arms 52,54.

In particular, the spring 50 comprises connecting portions 66,68 bent in a "U" or elbow, which connect the rear end 54",2" of the main arms 54,64 with the secondary arms 62,64.

Furthermore, the spring 50 includes an abutment portion 70 suitable to cooperate with the frame 2 to bring the spring 50 in abutment in a predefined position along the direction the dispensing axis Z.

In particular, the abutment portion 70 is brought in abutment, when the spring is correctly applied to the frame, with the connection duct wall 16*a*.

For example, the abutment portion 70 is constituted by a cross member 72 that joins said secondary arms 62,64, for example at the end opposite to that fitted to the main arms 52,54.

Preferably, the abutment portion 70, and in particular the cross member 72, is crossed by the sagittal plane S, extends perpendicularly with respect to this and is symmetrical with respect to said sagittal plane S.

Preferably, moreover, the abutment portion 70 has dimensions such as to be suitable to be arranged in the cavity 20 between the chamber wall 6*a* and the duct wall 10*a*.

By virtue of the cross member 72 that joins the two secondary arms 62,64, said cross member 72 and said secondary arms 62,64 form a cove 74 re-entering starting from the rear ends 52",54", in which is housable an engagement portion of the frame 2, for example the connection duct wall 16*a*.

At the mouth of the cove 74, the spring 50 has invitation portions 76,78 to the junction between the main arms 52,54 and the secondary arms 62,64, which form an invitation duct converging towards the interior of the cove 74. The engagement portion of the frame 2 is thus received in the cove 74.

According to a preferred embodiment, the spring 50 also comprises a constraint element 80 suitable to engage with the frame 2 to constrain the spring 50 to said frame 2 so as to increase the elastic action exerted by this on the trigger 30.

Preferably, the constraint element 80 comprises a plate 82 that extends from the abutment portion 70, preferably on the side opposite the cove 80.

The plate 82 has such dimensions such as to be suitable to be arranged in the cavity 20 between the chamber wall 6*a* and the duct wall 10*a*, and in particular a thickness (dimension in the direction of the skirt axis X) such as to insert itself with slight interference in the cavity 20 between the chamber wall 6*a* and the duct wall 10*a*.

In particular, the plate 80 goes in contact with the flat region 11 of the outer surface 10*a*' of the duct wall 10*a*, which forms a constraint counter-element 80' of the frame 2.

Figure 10A:
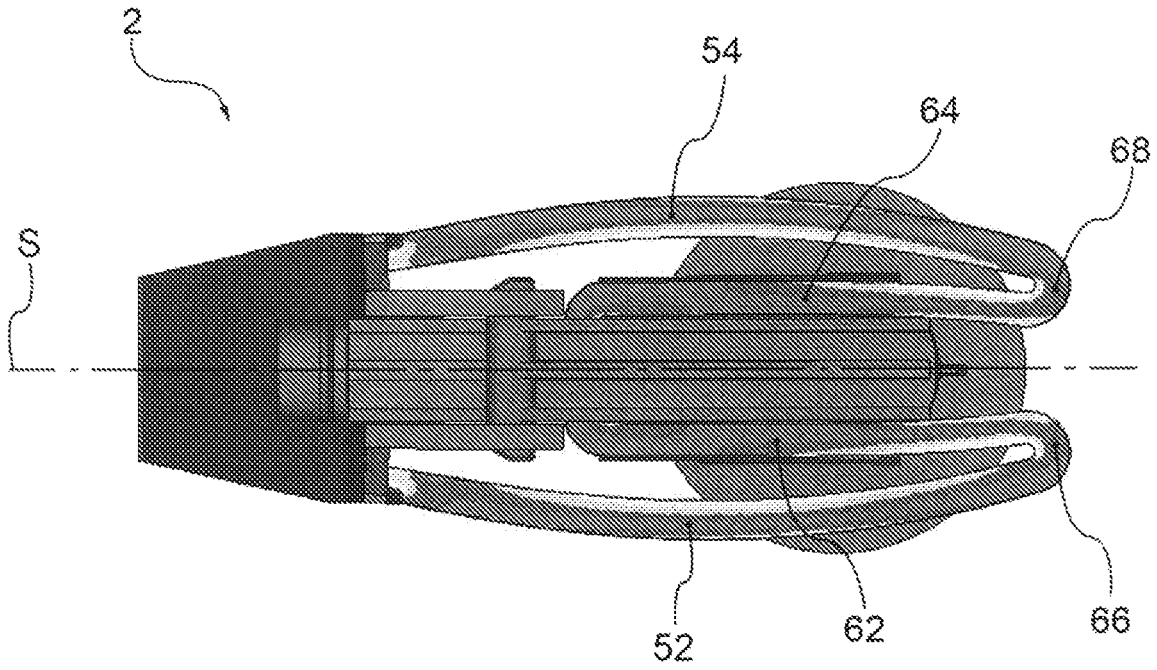
FIGS. 10*a* and 10*b* qualitatively show the tensional state of the integrated trigger-spring element, in an initial rest configuration.
Figure 10B:
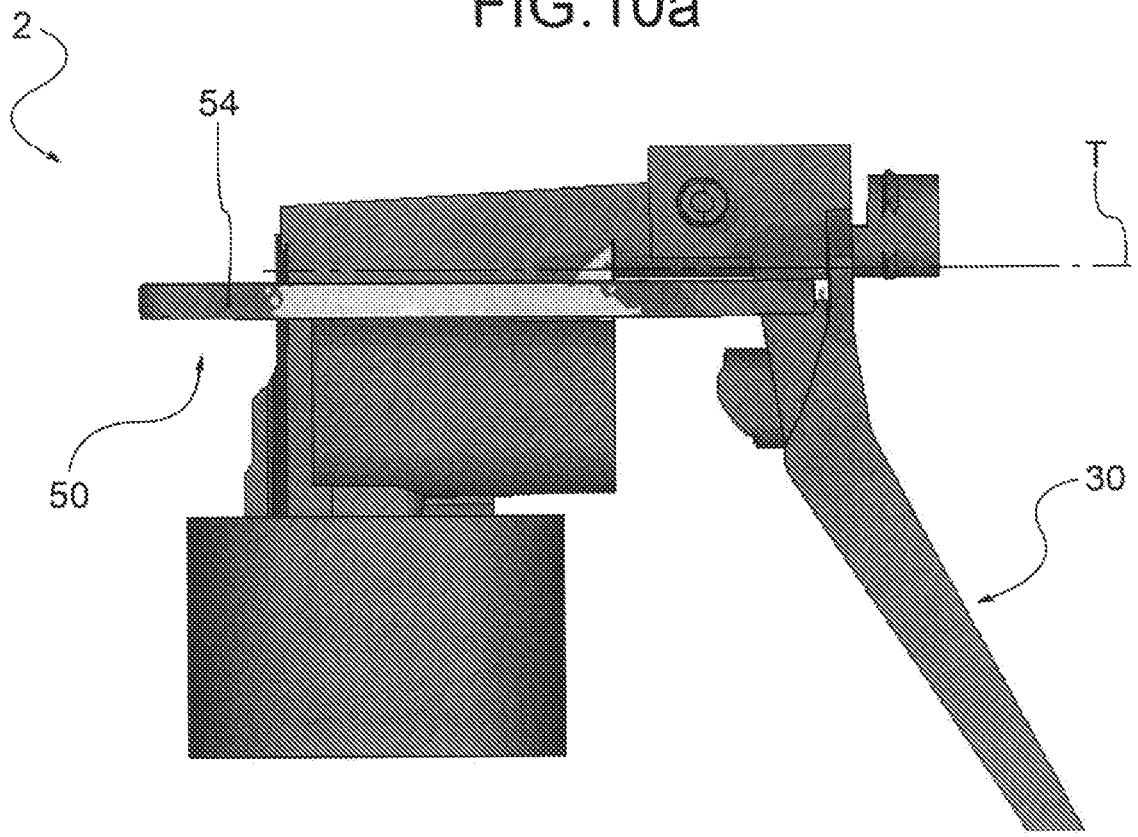

In a rest configuration, in which the trigger is not actuated by the user, the spring 50 is preferably located in a state of pre-compression, so that, advantageously, the play between the components is recovered and the trigger does not seem labile or ill-fitted to the user (FIGS. 10*a* and 10*b*).

In this rest configuration, the constraint element 80 is in abutment against the constraint counter-element 80 integral with the frame 2.

When the trigger 30 is actuated, the main arms 52,54 and the connecting portions 66,68 of the spring 30 undergo a noticeable deformation that causes the elastic return action on the trigger 30.

Figure 11A:
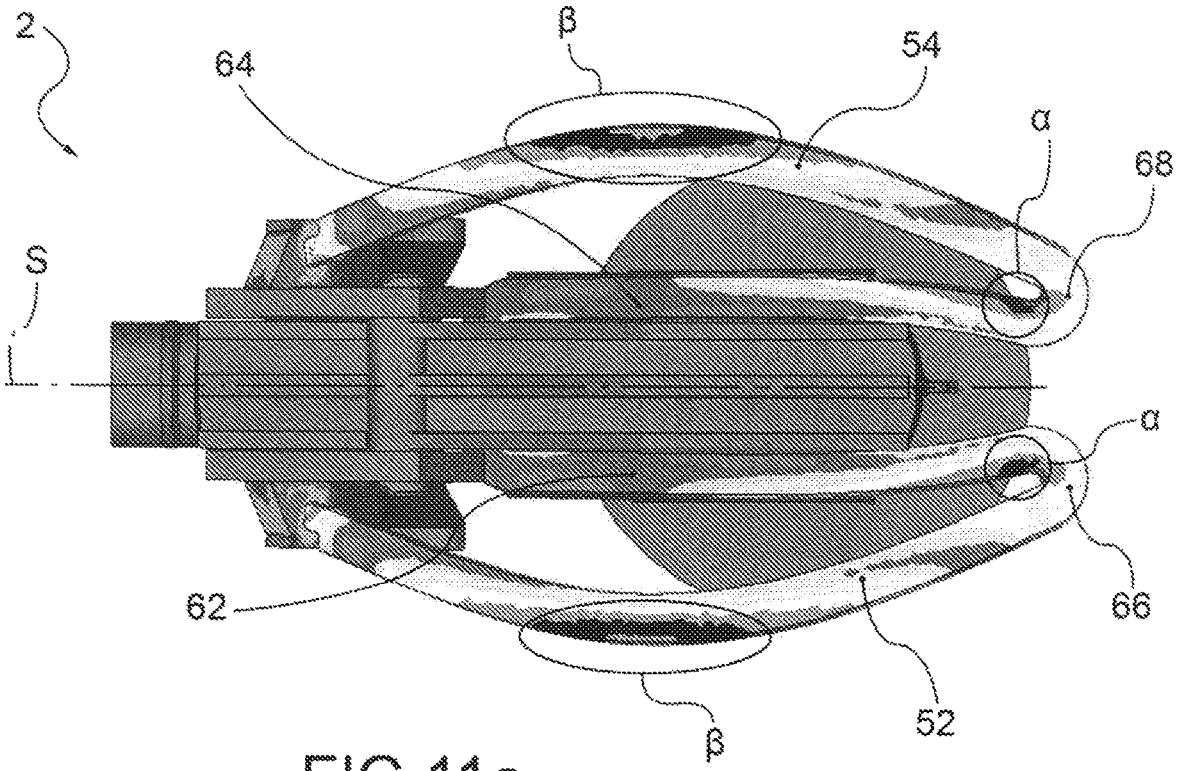
FIGS. 11*a* and 11*b* qualitatively show the tensional state of the integrated trigger-spring element, in an initial rest configuration.
Figure 11B:
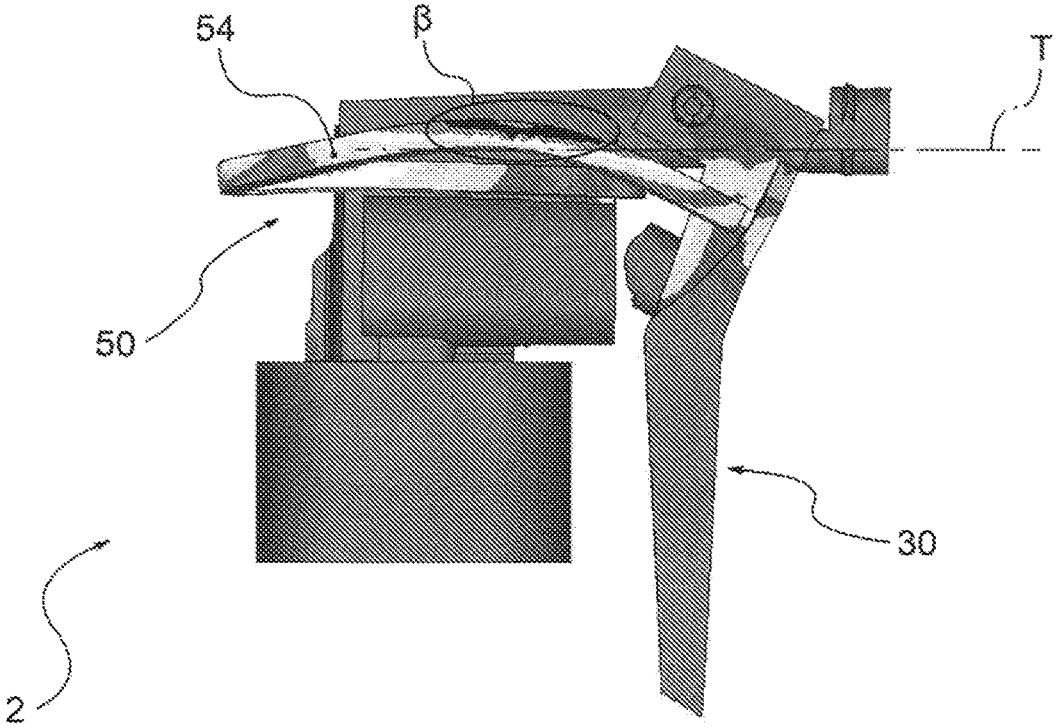

This deformation is particularly evident on the main arms 52,54, which undergo a flexion towards the transverse plane T (FIG. 11*a*) and away from the sagittal plane S (FIG. 11*b*).

Preferably, in a limit of actuation configuration, when the trigger 30 is in an end-of-stroke position, the deformed main arms 52,54 cross the transversal plane T and are brought at least partially in the upper half-space.

The connecting portions 66,68 also undergo a deformation, as is apparent from the tensions that are generated in certain circumscribed regions (regions α, FIG. 11*a*), comparable to those that are generated in certain regions (regions β, FIG. 11*a*) of main arms 52,54.

Innovatively, the dispensing head according to this invention meets the needs of the sector and overcomes the drawbacks referred to above.

In fact, by virtue of its conformation, the spring generates a significant return action on the trigger, even using a plastic material that is not excessively rigid and therefore less expensive. For example, the spring is made of a thermoplastic resin, such as PP (polypropylene).

Advantageously, this allows realising in a single piece both the trigger and the spring, by means of conventional injection moulding techniques, thereby avoiding the co-moulding of parts in different materials.

According to a further advantageous aspect, the spring allows obtaining the desired return action by containing the extent of the deformation of the arms; this allows limiting the overall dimensions of the spring at the maximum deformation, allowing it to be housed in the cover of the head.

Advantageously, moreover, the dispensing head allows a high-speed assembly of the components, and in particular of the spring or integrated trigger-spring element, since an insertion along the direction of the dispensing axis allows quickly applying the trigger-spring element to the frame.

According to a further advantageous aspect, the integrated trigger-spring element makes storage operations in the warehouse and the subsequent stages of assembly of the device less problematic stock.

In fact, as is known, the semi-finished trigger-spring elements, after moulding, are stored in large containers that typically contain several thousands of these components.

The containers are then moved to the assembly machine that, for example by means of vibrating tanks and linear feeders, correctly orients the component and then assembles it to the rest of the device.

However, the trigger-spring components arranged on the bottom of the containers are subjected to mechanical action, due to the weight of the components above, which tends to deform them, with consequent problems for correct orientation and assembly.

In addition, the injection moulded components, as is known, are subject to a dimensional shrinkage, which causes additional distortions. This phenomenon is particularly marked in "open" structures, such as the trigger-spring component referred to in document US 2009/0050653.

Instead, the trigger-spring component according to an embodiment of this invention presents a "closed" structure, i.e., a cove formed by the secondary arms and the cross member, which greatly limits the distortions, to the advantage of handling and post-moulding assembly operations.

It is clear that one skilled in the art, in order to meet contingent needs, may make changes the dispensing head described above, all contained within the scope of protection defined by the attached claims.

The invention claimed is:

1. An integrated trigger-spring element for a trigger-dispensing device, made in a single piece, comprising a trigger and a spring; the spring comprising:

i) a pair of main arms extending from a front end joined to the trigger at an opposite rear end substantially along a respective arm axis;

ii) secondary arms extending from the main arms as an extension along a respective extension axis separate from the arm axis;

iii) an abutment portion joining the secondary arms to each other;

wherein the abutment portion consists of a cross member joining said secondary arms to each other, wherein the cross member and the secondary arms form a cove curving inwards from the rear ends of the main arms; and wherein the main arms are arched convexly.

2. The dispensing head according to claim 1, wherein the trigger and the spring are made in a single, integrated trigger-spring element.

3. The dispensing head according to claim 2, wherein the front ends of the main arms are joined to the trigger.

4. The dispensing head according to claim 1, wherein the arm axes superpose at least partially the main arms in the direction of said arm axes.

5. The dispensing head according to claim 1, wherein the spring comprises connecting portions bent in a "U" shape or elbow, wherein the connecting portions connect the rear end of the main arms with the secondary arms.

* * * * *